US006352646B1

(12) United States Patent
Kiesel

(10) Patent No.: US 6,352,646 B1
(45) Date of Patent: Mar. 5, 2002

(54) PROCESSING METHOD FOR A METAL SURFACE

(75) Inventor: Gerd-Henning Kiesel, Garbsen (DE)

(73) Assignee: Benecke-Kaliko AG, Hannover (DE)

( * ) Notice: Subject to any disclaimer, the term of this patent is extended or adjusted under 35 U.S.C. 154(b) by 0 days.

(21) Appl. No.: 09/337,397

(22) Filed: Jun. 22, 1999

(30) Foreign Application Priority Data

Jul. 7, 1998 (DE) ..... 198 30 215

(51) Int. Cl.[7] ..... B44C 1/22; C23F 1/00

(52) U.S. Cl. ..... 216/9; 216/100

(58) Field of Search ..... 216/9, 100

(56) References Cited

U.S. PATENT DOCUMENTS 5,965,006 A * 10/1999 Baege et al. ..... 205/666

FOREIGN PATENT DOCUMENTS

DE 19636801 * 9/1996 ..... B24C/1/06

* cited by examiner

*Primary Examiner*—Randy Gulakowski
*Assistant Examiner*—Shamim Ahmed
(74) *Attorney, Agent, or Firm*—Shlesinger Arkwright & Garvey, LLP

(57) ABSTRACT

The invention concerns a method for processing a metal surface. To form an embossing surface, the metal surface is first provided with a coarsely cratered structure. After that, the surface is provided in a first blasting stage by blasting with particles or by etching or the like with a finely cratered structure of a first depth of roughness. Then the surface provided with the finely cratered structure of the first depth of roughness is coated within the vicinity of the troughs of the coarsely cratered structure with a protective coating and thereafter the peaks of the coarsely cratered structure projecting above the protective coating are provided by blasting with particle or etching or the like with a finely cratered structure of a second depth of roughness and lastly the protective layer is removed. With an embossing surface processed by the method of the invention, various appearances can be achieved in an embossed foil. If the coarsely cratered structure is a copy of the surface of natural leather, it is possible to substantially imitate the appearance of such leather provided the depth of roughness of the embossing surface within the vicinity of the peaks is greater than within the vicinity of the troughs, the reverse condition then being the case for the embossed product. The peaks are glossier than the troughs, which corresponds to the appearance of natural leather.

8 Claims, 1 Drawing Sheet

PROCESSING METHOD FOR A METAL SURFACE

FIELD OF THE INVENTION

The invention relates to a method to process metal surfaces.

BACKGROUND OF THE INVENTION

In a well-known procedure to produce a coarsely cratered structure in a metal embossing surface of embossing roller, first a silicone cast is made from a natural pattern and as a result the negative of the coarsely cratered structure is present on the surface of this cast, whereupon a positive of the coarsely cratered structure is made by new casting and the surface of this positive is provided with an electrically conductive coating onto which a metal layer, in general nickel, is deposited by plating. Following plating, the positive is removed and thereby the metal embossing surface with the negative of the pattern's coarsely cratered structure is exposed. Endowing the embossing surface thereafter with a fine structure by particle-blasting treatment or etching or the like in order to render it matte, for imparting the look of natural leather, is known.

It was found that a product embossed by such an embossing surface differs from a natural product in that the appearance of the natural pattern is not imparted.

The German patent document A1 196 36 801 discloses a procedure of the kind cited in the preamble of claim 1 wherein a steel band is moved through several processing chambers containing sand blasters acting on the surface of the band. The blaster effect is enhanced by the multiple exposures to the blasters. The different sand blasters do not produce a varying sand blasted effect.

The objective of the invention is to create a method of the kind cited in the preamble of claim for the processing of a metal surface with which a product can be embossed, in which the surface more closely resembles the natural pattern.

The basic concept of the invention is to provide the surface for forming an embossing surface with a coarsely cratered structure, and to provide the peaks and troughs of this structure with different fine cratered structures, i.e., different depths of roughness, whereby greater similarity is achieved between the embossed surface and the surface of a pattern, for instance natural leather. For this purpose, the entire embossing surface having the coarsely cratered structure is provided in the invention with a finely cratered structure of a first depth of roughness, whereupon the surface provided with a finely cratered structure of the first depth of roughness receives a protective coating which protects the embossing surface in the region of the troughs when, in a further method stage, the peaks of the coarsely cratered structure are provided by particle blasters or etching or the like with a finely cratered structure of a second depth of roughness. Following removal of the protective coating from the troughs, the embossing surface has the structure according to the invention, wherein the peaks and troughs have different finely cratered structures, that is depths of roughness or degrees of gloss.

Various surface appearances can be achieved using this method according to the invention. The depth of roughness may vary and either the peaks may be provided with a finely cratered structure of less depth of roughness than the troughs, or vice-versa.

In an advantageous embodiment of the invention, the protective coating is deposited across the peaks and troughs of the coarsely cratered structure and thereafter the protective layer is removed around the peaks of the coarsely cratered structure. Advantageously such removal can be implemented by wiping or scraping, preferably using means softening this protective coating.

DETAILED DESCRIPTION OF THE PREFERRED EMBODIMENTS

Figure 1:
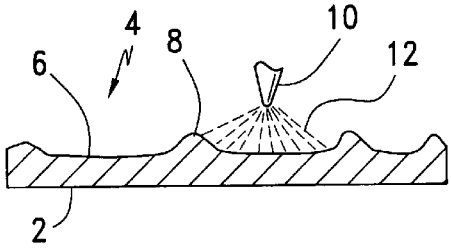
FIG. 1 illustrates a cross-sectional view of a portion of the coarsely cratered structure of an embossing roller according to the present invention showing a spray nozzle during formation of a first depth of roughness.

FIG. 1 is a detail in cross-section of an embossing roller 2, whose surface 4 has troughs 6 and peaks 8. Particles 12 are directed from a nozzle 10 by means of a carrying medium such as air or a liquid onto the surface 4, the size and nature of these particles being selected in such a manner that the finely cratered structure achieved by this blasting is of a comparatively slight depth of roughness.

Figure 2:
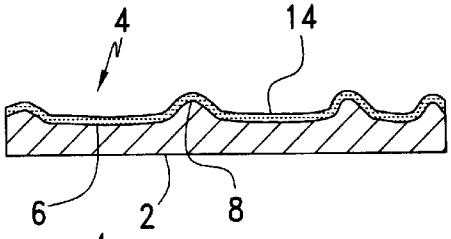
FIG. 2 illustrates application of protective coating deposited on the portion of the coarsely cratered structure shown in FIG. 1.

FIG. 2 corresponds to FIG. 1, a protective coating 14 having been deposited on the surface 4 which extends across the troughs 6 and peaks 8. This protective coating may be a sprayed-on varnish.

Figure 3:
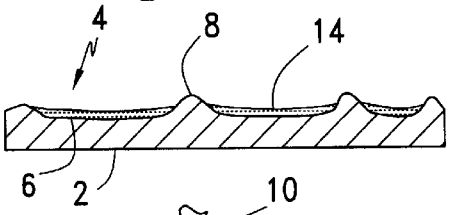
FIG. 3 illustrates the portion of the coarsely cratered structure shown in FIG. 2 with the protective coating removed from the peaks.

FIG. 3 elucidates the next method phase wherein the protective coating 14 has been removed within the vicinity of the peaks 8 and only remains in the region of the troughs 6. The removal of the protective coating from the peaks 8 may be carried out by wiping with the aid of a means softening the protective coating. However the protective coating 14 also may be deposited in liquid form using a doctor scraping across the peaks 8 during deposition to preclude any protective material remaining at these peaks.

Figure 4:
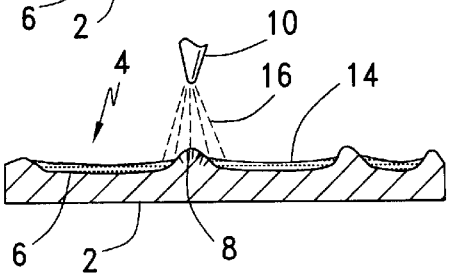
FIG. 4 illustrates a spray nozzle forming a second depth of roughness on the portion of the coarsely cratered structure.

FIG. 4 elucidates the next method phase wherein coarser particles 16 are sprayed from the nozzle 10 on the surface, only the exposed peaks 8 being impacted and thus receiving a roughness of a greater depth than that implemented in the method phase of FIG. 1 over the full surface.

Figure 5:
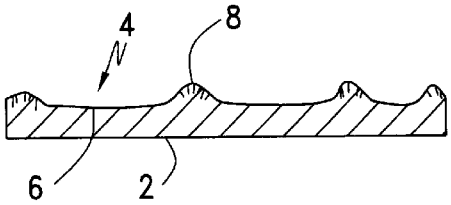
FIG. 5 illustrates the portion of the coarsely cratered structure following application of a second depth of structure and removal of the protective coating.

FIG. 5 shows the surface 4 after the protective coating has been removed from the troughs 6 so that the surface 4 forms an embossing surface having a coarse structure with troughs 6 and peaks 8, a finely cratered structure being superimposed on this coarse structure in the vicinity of the peaks which is of a greater, preferably substantially greater depth of roughness than the finely cratered structure in the vicinity of the troughs 6.

Figure 6:
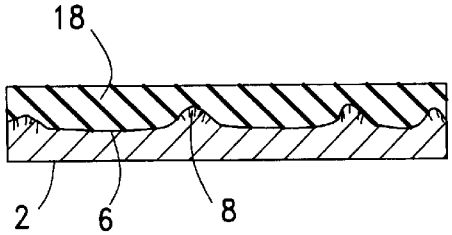
FIG. 6 elucidates the use of the embossing surface according to the present invention.

FIG. 6 elucidates the use of the embossing roller 2 to emboss a thermoplastic foil 18 under heat and pressure.

Figure 7:
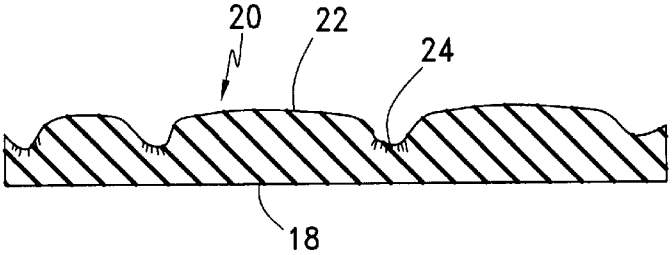
FIG. 7 is an enlarged detail of FIG. 6.

FIG. 7 shows, in an enlarged scale, the embossed foil 18, whose surface 20 has a positive of the surface structure of a leather pattern, whereas the surface 4 of the embossing roller 2 represents negative of the pattern of natural leather in a known way. Accordingly the surface 20 of the foil 18 shown in FIG. 7 has a coarse structure corresponding to the natural leather pattern whose peaks 22 have a finely cratered structure of slight depth of roughness so that the peaks 22 appear faintly glossy as seen in natural leather due to wear, whereas in the intact troughs 24, the finely cratered structure has a greater depth of roughness, so that the troughs appear more matte than the peaks 22.

Accordingly, the method of the invention allows the production of the surface of an embossing roller with which a foil can be embossed which offers substantially closer similarity to a natural leather pattern than is the case for the known embossing rollers.

What is claimed is:

1. A method for producing an embossing surface comprising the steps of:

a) providing a coarsely cratered metal surface having peaks and troughs;

b) spraying the metal surface with particles to produce a finely cratered surface thereon having a first depth of roughness;

c) applying a protective coating to the finely cratered metal surface so that at least the troughs are covered by the protective coating;

d) treating the coated metal surface to produce a finely cratered surface on the uncoated peaks, the finely cratered surface having a second depth of roughness; and e) removing the protective coating to provide an embossing surface having peaks and troughs having different depths of roughness.

2. The method of claim 1 and wherein the particles are sprayed onto the metal surface with a fluid from a nozzle disposed over the metal surface to produce a first depth of roughness.

3. The method of claim 1 and wherein the second depth of roughness is produced by spraying particles the size and nature of which are different than that used to produce the first depth of roughness.

4. The method of claim 1 and wherein the second depth of roughness is produced by etching.

5. The method of claim 1 and wherein the protective coating is applied to the entire metal surface and removed from the peaks prior to treatment to produce the second depth of roughness.

6. The method of claim 5 and wherein the protective coating is removed from the peaks by at least one of wiping or doctor scraping.

7. The method of claim 1 and wherein the depth of roughness on the peaks is greater than the depth of roughness in the troughs.

8. The method of claim 1 and wherein the second depth of roughness is produced by jet application of particles.

* * * * *